United States Patent [19]

Mizelle

[11] Patent Number: 4,592,102

[45] Date of Patent: Jun. 3, 1986

[54] MECHANISM FOR A SOFA SLEEPER

[76] Inventor: Ned W. Mizelle, P.O. Box 5985, High Point, N.C. 27262

[21] Appl. No.: 641,243

[22] Filed: Aug. 16, 1984

[51] Int. Cl.[4] ..... A47C 17/04

[52] U.S. Cl. ..... 5/13; 5/29; 5/56

[58] Field of Search ..... 5/13, 28, 29, 31–36, 5/56

[56] References Cited

U.S. PATENT DOCUMENTS

| | | | |
|---|---|---|---|
| 2,832,965 | 5/1958 | Pokorny, Jr. | 5/13 |
| 3,292,188 | 12/1966 | Gerth | 5/13 |
| 3,298,041 | 1/1967 | Rogers, Jr. | 5/13 |
| 3,516,096 | 6/1970 | Mikos | 5/31 |
| 3,657,747 | 4/1972 | Rogers, Jr. et al. | 5/13 |
| 3,871,035 | 3/1975 | Gerth | 5/13 |
| 4,068,328 | 1/1978 | Gerth | 5/13 |

*Primary Examiner*—Thomas J. Holko
*Assistant Examiner*—Michael F. Trettel
*Attorney, Agent, or Firm*—Beveridge, DeGrandi & Weilacher

[57] ABSTRACT

A rectangular mattress support frame has side rails formed of rail sections which are pivotally interconnected for movement between a folded seating position and an unfolded sleeping position. In the sleeping position, side rail portions projecting forwardly of the furniture frame are supported on a forward support leg and a center support leg. When a first rail section at the forward end of the side rail is pivoted upwardly, a linkage moves the forward support leg toward the first rail section, and this linkage also produces upward pivotal movement of a second rail section relative to a third rail section. The center leg is moved to a partially raised position in response to pivotal movement between the second and third rail sections, and it is moved to a fully raised position when a fourth rail section at the rear end of the side rail moves from a generally horizontal position to a generally vertical position. The fourth rail section is the back rail section, and it is one element of a four bar linkage which also includes a stationary mounting rail and two back support links which support the back rail section on the mounting rail. The back rail section moves translationally and inclinationally from a generally horizontal sleeping position to a generally vertical, rearward pitched, seating position. A lift lever on the mounting rail has one end connected to a tension spring and another end connected to a link which supports the side rail on the mounting rail.

29 Claims, 6 Drawing Figures

FIG 1
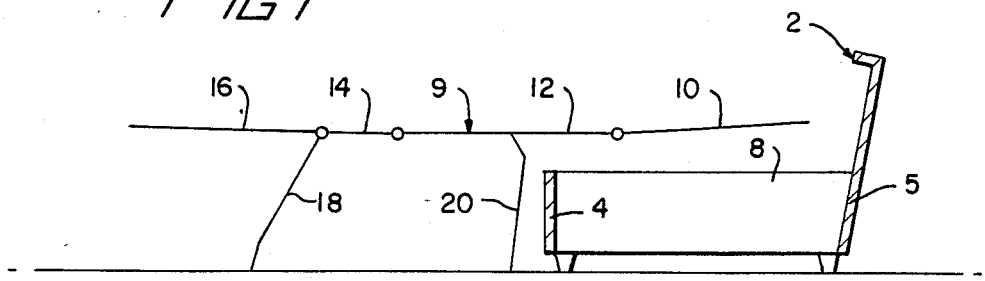
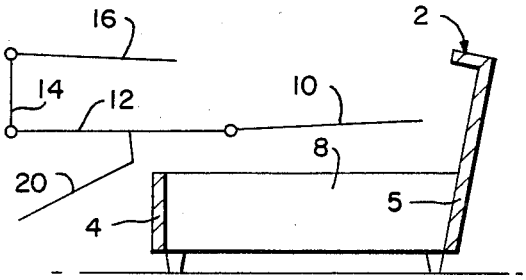
FIG 2
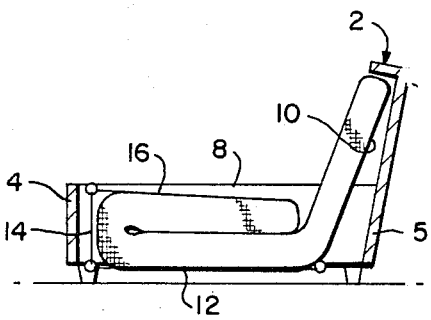
FIG 3
FIG 4
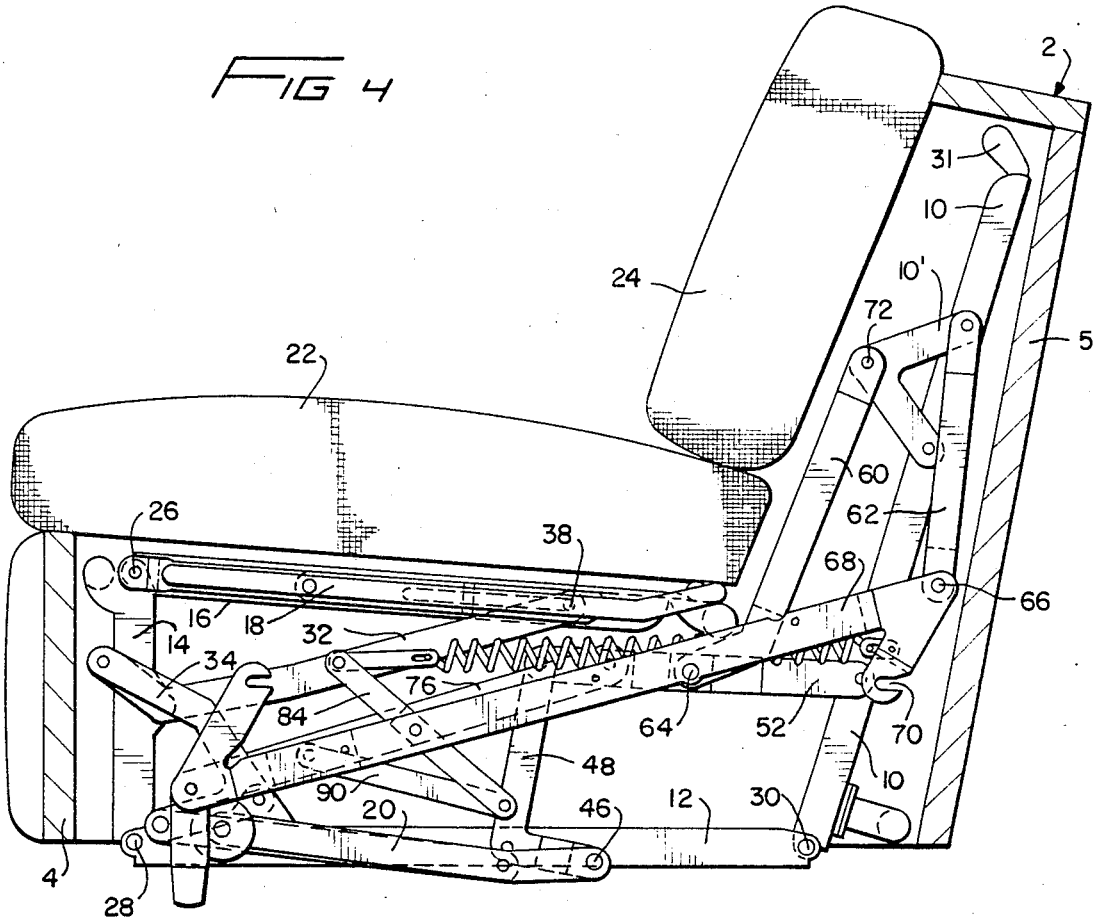

MECHANISM FOR A SOFA SLEEPER

BACKGROUND OF THE INVENTION

This invention relates to a mechanism of the type used in sofa sleepers wherein a foldable rectangular frame supports a deck which, in turn, supports the mattress. The opposed side rails of the frame are formed of sections which are pivotally interconnected to permit the folding of the frame.

Existing mechanisms of this nature, although generally satisfactory, often have shortcomings. For example, they may be formed of an excessive number of parts so that they are heavy, difficult to manufacture and therefore expensive. The mechanisms may be such that it is necessary to use a mattress which is shorter than standard length, and/or to use a sofa frame which has an excessive depth measured from its front to its rear. As a result of some folding arrangements and travel linkages, the seats of some sofa sleepers are higher than the seats of conventional sofas. Also, most mechanisms require the sofa frame to have an appearance which is somewhat different from that of a conventional sofa, in the respect that the backframe of the furniture frame is vertical rather than being rearwardly pitched. Another problem is that many sofa sleepers extend an excessive distance into the room from the furniture frame when they are in their unfolded sleeping positions.

One object of the present invention is to provide a sofa sleeper mechanism which is uncomplicated, utilizes relatively few parts, and has a substantial strength relative to its weight.

Another object of the invention is to provide a sofa sleeper with the appearance of a conventional sofa with respect to its height, depth, and the angulation of its back frame.

A further object of the invention is to provide a sofa sleeper mechanism which is operable with less floor clearance than is required in many sofa sleeper units, thereby making it possible to store the unit at a lower height.

Still another object is to provide a mechanism which minimizes the distance which the mattress extends into a room when the mechanism is in its unfolded sleeping position. This conserves floor space, and it also reduces the dependence of the mechanism on external legs for support of the mattress frame.

Persons familiar with the field of the invention will realize that there are additional attributes, and these will be evident from a study of the accompanying specification.

SUMMARY

Various features of this invention are applicable, inter alia, to a mechanism wherein a side rail is formed of rail sections which are pivotally connected in end-to-end relation to permit them to move between a folded seating position and an unfolded sleeping position. Typically, the sections of the side rail are a front rail section, a short center rail section, a long center rail section and a back rail section. When the mechanism is in its sleeping position, the sections of the side rail are generally aligned and horizontal; and, when the mechanism is in its folded seating position, the back rail in upstanding but rearwardly pitched, and the mattress is folded in a cavity formed by the front rail section, the short center rail section, and the long center rail section. In the folded position, the short center rail section is generally vertical, and the front rail section and long center rail section are generally horizontal.

According to one feature of the invention, a leg support lever is pivotally connected to the long center rail, and a center leg is pivotally connected to the leg support lever. Means are provided for moving the center leg from a floor-engaging position to a partially raised position in response to pivotal movement of the short center rail relative to the long center rail. Additionally, means are provided for moving the center leg to a fully raised position in response to movement of the back rail from its generally horizontal position to its generally vertical position. Stated more broadly, the leg is connected to one rail section, first means are operable to lift the leg from a floor engaging position to a partially raised position in response to pivotal movement between said one rail section and the rail section which is forwardly thereof, and second means are operable to lift the leg to a fully raised position in response to pivotal movement between said one rail section and the rail section which is rearwardly thereof.

Another feature of the invention relates to the support of the back rail section. According to this feature, the lower ends of two back support links are pivotally connected to a mounting rail which is mounted on the furniture frame. The back support links have different effective lengths and they are positioned so that their pivotal movement moves the back rail translationally and inclinationally to its generally vertical seating position.

The forward and rear back support links have their upper ends pivotally connected to the back rail at forward and rear control points. The rear support link is oriented to move the rear control point in an upward arcuate path in response to rearward movement of the back rail section, whereas the orientation of the forward support link is such that the forward control point moves in a downward direction in response to rearward movement of the back rail section. When the back rail is in its generally vertical position, the forward control point is lower than the rear control point.

The mechanism is preferably provided with a front support leg which contacts the floor when the mechanism is in its sleeping position. In one respect, the invention involves the linkage which actuates this support leg. This linkage is operable in response to upward pivotal movement of a first rail section to move the leg toward the first rail section and to produce upward pivotal movement of a second rail section relative to a third rail section. The linkage has a first link with one end slidably connected to the first rail section and another end pivotally connected to the front support leg, and a control lever pivotally mounted on the second rail section and having two lever arms connected respectively to one end of the first link and to a second link. The second link is also connected to the third rail section.

Another feature of the disclosed mechanism is a support leg, preferably the forward leg, pivotally connected to the side rail by the same pivot that interconnects two sections of the side rail.

In another respect, the invention involves the portion of the mechanism associated with a lift spring which assists a user in the initial lifting of the mattress from its folded seating position. A mounting rail on the furniture frame carries a lever which has an upwardly extending upper arm and a downwardly extending lower arm.

The lower arm of this lever is connected to a support link which supports the side rail on the mounting rail, whereas the upper arm of the lever is connected to a tension spring which extends rearwardly therefrom. The spring produces pivotal movement of the lever, thereby assisting in the movement of the support arm to a raised position.

Furthermore, the mechanism has a number of significant ancillary features which are illustrated in the drawings, described in the detailed description, and recited in the dependent claims. These features will be evident to persons familiar with furniture mechanisms.

BRIEF DESCRIPTION OF THE DRAWINGS

FIG. 1 is a diagrammatic view of a sofa sleeper which utilizes the improved mechanism of the invention, wherein the mechanism is in its generally horizontal unfolded sleeping position.

FIG. 2 is a view similar to FIG. 1, but showing the mechanism in its partially folded position.

FIG. 3 is a view similar to FIGS. 1 and 2 but showing the mechanism in its fully folded seating position.

FIG. 4 is a detailed drawing of the mechanism when in its folded seating position.

DESCRIPTION OF A PREFERRED EMBODIMENT

This invention is suitable for sofa sleepers where a mattress is supported on a wire link deck which is connected by helical springs to a foldable rectangular frame.

Figure 5:
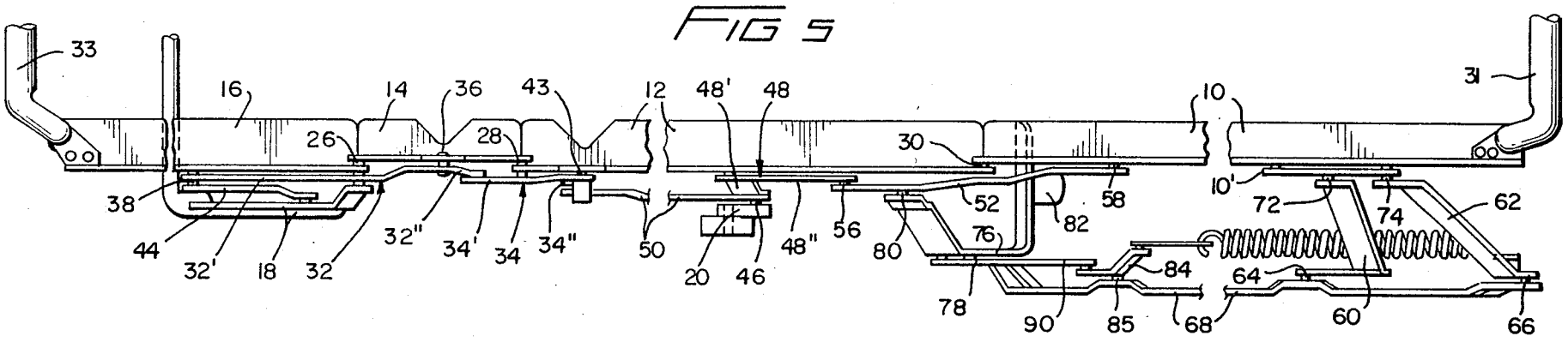
FIG. 5 is a detailed partially broken plan view of the mechanism when in its unfolded sleeping position.
Figure 6:
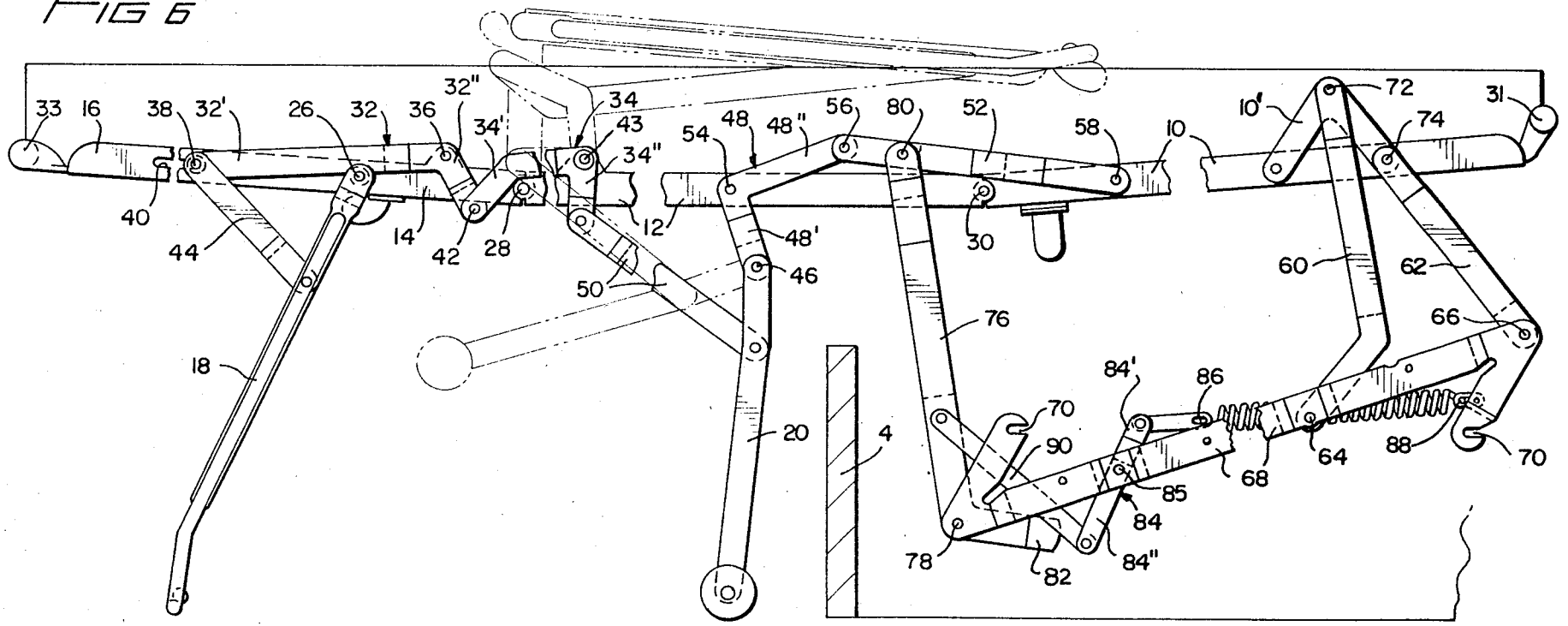
FIG. 6 is a detailed partially broken side view of the mechanism when in its unfolded sleeping position. This drawing also shows in dot-dash lines the positions of certain elements of the mechanism when they are in a partially folded position corresponding to the position illustrated diagrammatically in FIG. 2.

The mechanism shown in detail in FIGS. 4, 5 and 6 is attached to the left side frame of an upholstered sofa frame, and it includes one foldable side rail of the foldable rectangular frame. A similar but mirror image version of this mechanism is attached to the right side frame of the sofa. The side rails of these two mechanisms are connected together by transverse head and foot rails to form the rectangular support frame for the mattress deck.

FIG. 1 shows in diagrammatic form an upholstered sofa frame 2 which includes a front rail 4, a back frame 5 and two side frames, one of which is shown at 8. There is no breast rail, so the back cavity of the sofa frame is open in a forward direction. The mattress supporting mechanism has a side rail 9 formed of a plurality of rail sections which are pivotally interconnected in end-to-end relationship to permit them to move between a lower folded seating position shown in FIG. 3 and an unfolded sleeping position where they are generally aligned and horizontal as shown in FIG. 1. These side rail sections comprise a back rail 10, a long center rail 12 pivotally connected to the forward end of the back rail, a short center rail 14 pivotally connected to the forward end of the long center rail, and a front rail 16 pivotally connected to the forward end of the short center rail. When the mechanism is in the seating position, the back rail 10 and short center rail 14 are generally vertical, and the front rail 16 and the long center rail 12 are generally horizontal. In this position, the front rail 16 lies above the long center rail 12 to form a cavity for holding portions of a mattress folded therewithin. The back rail, when in the generally vertical position, is preferably pitched rearwardly about 15° to 30° from a true vertical orientation to give the forward and rear surfaces of the sofa back an angulation which resembles that of a conventional sofa.

When the mechanism is in the sleeping position shown in FIG. 1, the side rail is supported by a front leg 18, a center leg 20 and the side frame sections 8 of the sofa frame 2. The exertion of a lifting force on the front of the side rail 9 will move the mechanism to the partially folded condition shown in FIG. 2. At this position, the front support leg 18 is fully raised and stored, and the center support leg 20 is in a partially raised position. Finally, rearward movement of the side rail causes its back section 10 to move to the upstanding, rearwardly pitched position shown in FIG. 3, while the cavity formed by the mattress-enclosing side rail sections 12, 14 and 16 moves rearwardly and is lowered into the space between the side frame sections 8 of the sofa frame 2. At this point, loose seat cushions and back cushions may be placed in the positions shown at 22 and 24 in FIG. 4.

The details of the mechanism are shown best in FIGS. 3, 4 and 5, where the pivots which connect the side rail sections are designated 26, 28 and 30. The pivot 26 serves the dual functions of interconnecting the rail sections 14 and 16, and connecting the front leg 18 to the side rail 9, thereby simplifying the mechanism and reducing the number of parts required. FIGS. 5 and 6 also show the transverse head rail 31 and the transverse foot rail 33 which are connected to the front and rear ends of the side rails to form the frame of the mattress support deck.

CAVITY CONTROL AND FRONT LEG LIFT LINKAGE

The mechanism for controlling the relative pivotal movement between the rail sections 12, 14 and 16 includes a lever 32 and a link 34', which is an arm of a lever 34. The lever 32 is pivotally connected at 36 to the short center rail 14. The forward arm 32' of lever 32 carries a pivot 38 which is slidably received in an elongated slot 40 in the front rail 16. The rear arm 32'' of lever 32 is pivotally connected at 42 to the link 34' which is mounted on the rail section 12 by a pivot 43. The lengths and orientations of these members are such that upward movement of the forward end of the front rail section 16 will cause the lever 32 to rotate in a clockwise direction. The elevation of lever 32 will, acting through pivot 36, lift the short center rail 14 to the vertical orientation shown in FIG. 2 and shown in broken lines in FIG. 6.

As the front rail section 16 is being lifted and the lever 32 pivots in a clockwise direction, the pivot 38 slides forwardly in the elongated slot 40 in the front rail. This movement also causes the front leg link 44 to slide forwardly, thereby raising the front leg 18 by moving it about the pivot 26. When the pivot 38 reaches the forward end of the slot, the rail section 16 arrives and stops at the position shown in broken lines in FIG. 6. The leg 18 is then at its fully raised position.

From the foregoing, it will be appreciated that the mechanism has a linkage which is operable in response to upward pivotal movement of a first rail section 16 to move the support leg 18 toward the rail section 16 and to produce upward pivotal movement of a second rail section 14 relative to a third rail section 12. This linkage includes a first link 44 which has one end slidably connected to the rail section 16 and another end pivotally connected to the front support leg 18. A control lever 32 is pivotally mounted on the second rail 14 and has one arm 32" connected to a link 34' and another arm 32' connected to the end of the first link 44. The second link 34' is connected to the third rail section 12.

CENTER LEG CONTROL LINKAGE

One feature of this mechanism is that the center leg 20 moves from its supportive floor-engaging position shown in FIG. 6 to a partially raised position in response to pivotal movement between the rail section 12 and the rail section 14 which is immediately forward thereof. During a subsequent phase of the folding sequence, the leg 20 is moved to its fully raised position in response to pivotal movement between the rail section 12 and the rail section 10 which is rearwardly thereof.

As shown in FIG. 6, the center leg 20 is connected at 46 to the rail section 12 by an arm 48' of a lever 48. The mechanism for raising the leg 20 from its floor-engaging position to its partially raised position includes the lever 34, a link 50 which connects the leg 20 to the arm 34" of lever 34, and the arm 32" which provides a link connecting the arm 34' of lever 34 to the rail section 14. When the rail section 14 swings upwardly on pin 28 relative to the rail section 12, the link 32" moves the lever 34 in a clockwise direction about its pivot 43. This movement causes the arm 34" of lever 34 to move forwardly so the link 50 lifts the center leg 20 to its partially raised position.

The mechanism which moves the center leg 20 to its fully raised position includes the lever 48 and a link 52. The lever 48 is pivoted at 54 to the rail section 12. This lever has one arm 48' connected by pivot 46 to the upper end of the center leg 20, and another arm 48" connected at 56 to the rear end of a link 52. The forward end of the link 52 is pivotally connected at 58 to the back rail section 10, i.e. the rail section which lies rearwardly of the rail section 12 on which the center leg 20 is mounted. When the mechanism move from the position shown in FIG. 2 to the position shown in FIG. 3, the pivotal movement between the rail sections 10 and 12 causes the link 52 to act as a retractor link which rotates the lever 48 in a counterclockwise direction. The leg-supporting pivot 46 thus swings forwardly and upwardly toward the rail section 12 until it reaches its retracted position which is generally parallel to the rail section 12. The leg 20 then occupies a fully raised position which is substantially horizontal and generally parallel to the rail section 12 as shown in FIG. 4.

The lever arm 48" and the link 52 also serve as control links which control the pivotal movement between the rail sections 10 and 12.

BACK RAIL CONTROL LINKAGE

The back rail section is supported by a pair of links 60 and 62. These links are arranged to permit movement of the back rail section 10 from the generally horizontal position shown in FIGS. 1 and 6 to the position of FIG. 4 where it is generally vertical, upstanding and rearwardly pitched. This movement occurs in response to rearward movement of the back rail section.

The lower ends of the back support links 60 and 62 are connected by pivots 64 and 66 to a mounting rail 68 which, in turn, is rigidly attached to the furniture frame, preferably by fasteners which extend through the open ended slots 70. The upper ends of the links 60 and 62 are connected to the back rail 10 by pivots 72 and 74 which define two control points for the back rail movement. The pivot 72 is connected to an inverted V-shaped piece 10' which is rigidly affixed to the back rail 10 and is regarded as part of the back rail 10 for all practical purposes.

It will be recognized that the four rigid elements 10, 60, 62 and 68 associated with the pivots 64, 66, 72 and 74 form a four bar linkage which controls the movement of the back rail 10 relative to the furniture frame. In FIG. 6, the disposition of this linkage is such that the rearward pivotal movement of the links 60 and 62 will move the back rail 10 translationally and inclinationally from its general horizontal sleeping position to its generally vertical seating position. As previously mentioned, this generally vertical position is preferably pitched rearwardly about 15° to 30° so that the forward and rear surfaces of the sofa back may have an angulation similar to that of a conventional sofa. The rear link 62 is oriented so that the rear control point 74 will move in an upward arcuate path in response to rearward movement of the back rail section 10. The orientation of the forward support link 60 is such that rearward movement of the back rail section 10 will result in movement of the forward control point 72 in a downward arcuate path. At the conclusion of its rearward movement, the back rail section 10 will be in its generally vertical position, and the forward control point 72 will be lower than the rear control point 74.

As can been seen in FIG. 6, the forward support link 60 has a greater effective length than the rear support link 62. The effective length is the straight line distance from pivot to pivot. The forward pivot axis 64 is forward of and lower than the pivot axis 66 of the rear link 62. When the back rail section 10 is in the generally horizontal position shown in FIG. 6, the forward support link 60 has a greater effective inclination than the rear link 62, i.e. a line through pivots 64 and 72 lies at a greater angle from the horizontal than a line through the pivots 66 and 74. However, when the back rail section is in its upstanding orientation shown in FIG. 4, the rear support link 62 has the greater effective inclination.

As to the locations of the control points of the four bar linkage, the forward control point 72 is higher than and forward of the rear control point 74 when the back rail section is in its generally horizontal position.

To provide supplemental support to the side rail when the mechanism is in the sleeping position, there is a third support link 76 for supporting the rail sections 10 and 12. This link is located forwardly of the forward support link 60. Its lower end is pivotally connected to the mounting rail 68 at 78, and its upper end is pivotally connected to the rail section 10 by pivot 80 and the previously-described control link 52. A foot 82 is located on the lower end of the link 76 to engage the floor and provide support to the unit when it is in the position shown in FIG. 4.

LIFT MECHANISM

The apparatus is provided with a lifting mechanism which is of assistance when raising the unit from the seating position shown in FIG. 4. This particular mechanism is desirable because, in contrast to other spring-assisted lifting mechanisms, it requires a smaller spring, it applies the force generated by the spring at an optimum angle and location, and it permits the spring to be located a substantial distance above the floor where it cannot be seen from the side of the sofa.

The lifting mechanism is illustrated best in FIG. 6 where it will be seen that it includes a lever 84 which is pivotally supported on the mounting rail 68 at 85. The upper arm 84' of the lever is provided with an eye 86 for receiving one end of a tension spring. The spring extends rearwardly from the eye 86 to a stationary eye 88 on the mounting rail. The lower arm 84" of the lever is connected by a compression link 90 to the support link 76, whereby the lifting mechanism will transmit lifting forces from a spring to the support link via the lever 84. The disposition of the lever 84 is such that its lower arm extends rearwardly from the pivot when the support link 76 is in the lowered position shown in FIG. 4; however, when the support link 76 is in the raised position of FIG. 6, the lower arm of the lever extends forwardly from the pivot.

The furniture frame is upholstered in a conventional manner. However, since portions of the mattress may be exposed because the sofa frame 2 does not have a breast rail, the exposed portions of the mattress may be provided with a slip cover or may be self decked with a coordinated upholstery fabric. The pillows 24 may be loose, or they may be semi-attached to the top of the backframe 5 by a fabric hinge which permits them to be folded up and out of the way.

Persons familiar with the art will realize that the invention may take many forms other than the preferred embodiment disclosed herein. For example, the mechanism may be used in connection with a chair or love seat rather than a full width sofa. The mechanism may be modified in many respects to embody one or more of the desirable features described above. Therefore, it is emphasized that the invention is not limited solely to the disclosed embodiment, but is embracing of a variety of mechanism which fall within the spirit of the following claims.

I claim:

1. A mechanism for supporting a mattress in an article of furniture such as a sofa sleeper, said mechanism comprising:

a back rail, a long center rail pivotally connected to the forward end of the back rail, a short center rail pivotally connected to the forward end of the long center rail, and a front rail pivotally connected to the forward end of the short center rail, said rails being pivotally movable from a sleeping position where they are generally aligned and horizontal to a seating position where said back rail and said short center rail are generally vertical and said front rail and said long center rail are generally horizontal, said front rail when in the seating position lying above the long center rail to form a cavity for holding portions of a mattress folded therewithin, said mechanism being arranged so that movement of the rails, from the sleeping position to the seating position occurs in first and second phases and includes a stable intermediate position where the back rail and long center rail occupy the positions they had in the sleeping position and the front rail lies above and is generally horizontal and parallel to the long center rail, said first phase of movement including pivotal movement of the front rail and the short center rail while the long center rail and back rail are stationary, said second phase of movement including pivotal movement of the back rail relative to the long center rail while the front rail and short center rail remain stationary with respect to the long center rail, a leg support lever pivotally connected to said long center rail, a center leg pivotally connected to said leg support lever, said center leg being movable from a lower floor-engaging position to a partially raised position and to a fully raised position, means for moving said center leg to its partially raised position during said first phase in response to pivotal movement of said short center rail relative to said long center rail, and means for moving said center leg to its fully raised position during said second phase in response to movement of said back rail from its generally horizontal position to its generally vertical position.

2. A mechanism for supporting a mattress in an article of furniture such as a sofa sleeper, said mechanism comprising:

a side rail formed of a plurality of rail sections which are pivotally interconnected in end-to-end relationship to permit movement between a folded seating position and an unfolded sleeping position, a leg connected to one rail section, said leg being in a floor-engaging position when the mechanism is in its unfolded sleeping position, said mechanism being arranged so that movement of the rail sections from the unfolded sleeping position to the folded seating position occurs in first and second phases and includes a stable intermediate position where said one rail section and the rail section which is rearwardly thereof occupy the positions they had in the sleeping position and a rail section which is located forwardly of said one rail section and lies above and is generally horizontal and parallel to said one rail section, said first phase of movement including pivotal movement of said rail section which is located forwardly of said one rail section while said one rail section and the rail section which is rearwardly thereof are stationary, said second phase of movement including pivotal movement between said one rail section and the rail section which is rearwardly thereof without any pivotal movement between the one rail section and the rail section which is forwardly thereof, first means for lifting said leg to a partially raised position in response to pivotal movement between said one rail section and the rail section which is forwardly thereof during said first phase of movement, and second means for lifting the leg to a fully raised position in response to pivotal movement between said one rail section and the rail section which is rearwardly thereof during said second phase of movement.

3. A mechanism according to claim 2 wherein the first means includes a first lever which is pivotally mounted on said one rail section, said lever having a first arm and a second arm, a first link connecting said first arm of the first lever to said support leg, and a second link which connects said second arm of the first lever to the rail section located forwardly of one rail section; and the second means includes a second lever which is pivotally mounted on said one rail section, said second lever having a first arm and a second arm, said first arm of the second lever connecting said support leg to said one rail section, and a link connecting said second arm of the second lever to the rail section located rearwardly of said one rail section.

4. A mechanism according to claim 2 wherein the first means includes a lever which is pivotally mounted on said one side rail section, said lever having a first arm and a second arm, a first link connecting said first arm to said support leg, and a second link which connects said second arm to the rail section located forwardly of said one rail section.

5. A mechanism according to claim 4 wherein said second link and said second arm comprise means for controlling the pivotal movement between said one rail section and the rail section which is located forwardly thereof.

6. A mechanism according to claim 2 wherein the second means includes a lever which is pivotally mounted on said one rail section, said lever having a first arm and a second arm, said first arm connecting said support leg to said one rail section, and a link connecting said second arm to the rail section located rearwardly of said one rail section.

7. A mechanism according to claim 6 having a support link with a pivoted lower end and an upper end pivotally connected to the link which is connected to the second arm of the lever.

8. A mechanism according to claim 7 wherein said second arm of the lever and the link connected thereto comprise means for controlling the pivotal movement between said one rail section and the rail section which is located rearwardly thereof.

9. A mechanism for supporting a mattress in an article of furniture such as a sofa sleeper, said mechanism comprising:

a back rail, a long center rail pivotally connected to the forward end of the back rail, a short center rail pivotally connected to the forward end of the long center rail, and a front rail pivotally connected to the forward end of the short center rail, said rails being pivotally movable from a sleeping position where they are generally aligned and horizontal to a seating position where said back rail and said short center rail are generally vertical and said front rail and said long center rail are generally horizontal, said front rail when in the seating position lying above the long center rail to form a cavity for holding portions of a mattress folded therewithin, mounting rail means for mounting the mechanism on a furniture frame, a pair of back support link means, each of which has a lower end pivotally connected to the mounting rail means and an upper end pivotally connected to the back rail, said back support link means having different effective lengths and being positioned so that pivotal movement thereof moves the back rail translationally and inclinationally from its generally horizontal sleeping position to its generally vertical seating position.

10. A mechanism according to claim 9 having a third support link which has one end pivotally connected to the mounting rail means and another end linked to at least one of said rails, a lifting mechanism operable to transmit force from a spring to assist a user in moving the long center rail to its seating position, said lifting mechanism including a lever, said lever being pivotally supported on said mounting rail means, said lever having a first end provided with means for connecting it to a spring, said lever having a second end linked to said third support link, said lifting mechanism being operable to transmit lifting forces from a spring via said lever to said third support link.

11. A mechanism for supporting a mattress in an article of furniture such as a sofa sleeper, comprising, a side rail formed of a plurality of rail sections which are pivotally interconnected in end-to-end relationship to permit movement thereof between a folded seating position and an unfolded sleeping position, said rail sections including a back rail section and at least three cavity-forming rail sections which are forward of the back rail section, said cavity-forming rail sections being foldable to form a cavity for storing at least a portion of a mattress when the unit is in its folded seating position, means for supporting the back rail section for movement from a generally horizontal position to a generally vertical position in response to rearward movement of said back rail section, said means including a forward support link and a rear support link, said forward support link having a lower end which is supported for pivotal movement about a forward pivot axis and having an upper end connected to the back rail section at a forward control point, said rear support link having a lower end which is supported for pivotal movement about a rear pivot axis and having an upper end connected to the back rail section at a rear control point, said rear support link being oriented to move the rear control point in an upward arcuate path in response to rearward movement of the back rail section, said forward support link being oriented to move the forward control point in a downward arcuate path in response to rearward movement of the back rail section, said forward control point being lower than the rear control point when the back rail section is in its generally vertical position.

12. A mechanism according to claim 11 wherein said forward pivot axis of the forward support link is lower than and forward of said rear pivot axis of the rear support link.

13. A mechanism according to claim 12 wherein said forward control point is higher than and forward of said rear control point when said back rail section is in its generally horizontal position.

14. A mechanism according to claim 11 wherein the forward support link has a greater effective inclination from the horizontal than the rear support link when the back rail section is in its generally horizontal position, said rear support link having a greater effective inclination from the horizontal than the forward support link when the back rail section is in its generally vertical position.

15. A mechanism according to claim 14 wherein the forward support link has a greater effective length than the rear support link.

16. A mechanism according to claim 11 having a third support link for supporting the back rail section, said third support link being located forwardly of said forward support link, said third support link having a lower end supported for pivotal movement about a third pivot axis, and a link connecting the upper end of the third support link to said back rail section.

17. A mechanism according to claim 11 having control means for controlling the relative folding movement between the back rail section and the rail section located forwardly thereof, said control means including a pair of control links, said control links being pivotally connected to each other and having their opposite ends connected respectively to the back rail section and to said rail section located forwardly thereof.

18. A mechanism according to claim 17 having a third support link for supporting the back rail section, said third support link being located forwardly of said forward support link, said third support link having an upper end connected to one of said control links and a lower end supported for pivotal movement about a third pivot axis.

19. A mechanism according to claim 17 having a lever which is pivotally mounted on the rail section which is located forwardly of said back rail section, said lever having a first arm and a second arm which is one of said control links, and a floor-engaging support leg connected to said first arm.

20. A mechanism which supports a mattress in a sofa sleeper, comprising, a side rail formed of a plurality of pivotally interconnected rail sections which are movable from a folded seating position to an unfolded sleeping position, said rail sections when in said sleeping position being aligned and generally horizontal, said rail sections when in said seating position being lowered and folded to form a cavity for storing a folded mattress, each said rail section having a forward end and a rear end which are disposed forwardly and rearwardly when the mechanism is in its unfolded sleeping position, said mechanism when in said unfolded sleeping position having a first said rail section disposed forwardly on said side rail, a second said rail section which has its forward end pivotally connected to the rear end of said first rail section, a third said rail section which has its forward end pivotally connected to the rear end of said second rail section, a front support leg pivotally connected to said first rail section, said front support leg being in a floor-contacting position when the sections are in said unfolded sleeping position, linkage means operable in response to upward pivotal movement of said first rail section to move the support leg toward the first rail section and to produce upward pivotal movement of the second rail section relative to the third rail section; said linkage means including a first link, a control lever and a second link; said first link having one end slidably connected to the first rail section and another end pivotally connected to the front support leg; said control lever being pivotally mounted on said second rail section and having one arm connected to said second link and another arm connected to said one end of the first link, said second link also being connected to said third rail section.

21. A unit according to claim 20 having a center support leg, means for mounting the center support leg on said third rail section, said second link comprising a portion of a second lever, center leg control means for raising said center support leg in response to upward pivotal movement of said first and second rail sections, said center leg control means including a link which is connected to the center support leg and to said second lever.

22. A mechanism according to claim 20 wherein the means for mounting the center support leg on the third rail section includes a center leg lever which is pivotally supported on the third rail section and has an arm connected to the center support leg, said arm of the center leg lever being movable from an extended position where it projects downwardly from the third rail section to a retracted position where it is generally parallel to said third rail section, said center support leg being generally parallel to said third rail section when said arm of the center leg lever is in its retracted position.

23. A mechanism according to claim 22 having a fourth rail section pivotally connected to the rear of said third rail section, a control linkage for moving the arm of the center leg lever from its extended position to its retracted position, said control linkage including a retractor link which connects the center leg lever to said fourth rail.

24. A mechanism according to claim 23 having a support link which has one end pivotally connected to said retractor link and another end mounted on a stationary pivot which is lower than said third rail section.

25. A mechanism for supporting a mattress in an article of furniture such as a sofa sleeper, said mechanism comprising:

a side rail formed of a plurality of side rail sections which are pivotally interconnected in end-to-end relationship to permit movement between a folded seating position and an unfolded sleeping position, mounting rail means for mounting the mechanism on a sofa sleeper frame, support link means for supporting at least one of said side rail sections on the mounting rail means, said support link means having a lower end which is pivotally connected to the mounting rail means to permit the support link means to swing upwardly and forwardly from a lowered position to a raised position, a lever connected to the mounting rail means by a pivot, said lever having an upper arm extending above the mounting rail means and a lower arm extending below the mounting rail means, means connecting the lower arm of the lever to the support link means, tension spring means connected to and extending rearwardly from the upper arm of the lever, said tension spring means being operable to produce pivotal movement of said lever to assist the movement of the support link means from its lowered position toward its raised position.

26. The mechanism of claim 25 wherein the means connecting the lower arm of the lever to the support link means is a link which has opposite ends pivotally connected respectively to the support link means and to the lower arm of the lever.

27. The mechanism of claim 25 wherein the lower arm of the lever extends rearwardly from said pivot when the support link means is in its lowered position, said lower arm of the lever extending forwardly from said pivot when the support link means is in its raised position.

28. The mechanism of claim 27 wherein the means connecting the lower arm of the lever to the support link means is a link which has opposite ends pivotally connected respectively to the support link means and to the lower arm of the lever.

29. A mechanism for supporting a mattress in an article of furniture such as a sofa sleeper, said mechanism comprising:

a side rail formed of a plurality of rail sections which are pivotally interconnected in end-to-end relationship to permit movement between a folded seating position and an unfolded sleeping position, a leg connected to one rail section, said leg being in a floor-engaging position when the mechanism is in its unfolded sleeping position, first means for lifting said leg to a partially raised position in response to pivotal movement between said one rail section and the rail section which is located forwardly thereof, and second means for lifting the leg to a fully raised position in response to pivotal movement between said one rail section and the rail section which is rearwardly thereof, said first means including a first lever which is pivotally mounted on said one rail section, said lever having a first arm and a second arm, a first link connecting said first arm of the first lever to said support leg, and a second link which connects said second arm of the first lever to the rail section located forwardly of said one rail section; and the second means includes a second lever which is pivotally mounted on said one rail section, said second lever having a first arm and a second arm, said first arm of the second lever connecting said support leg to said one rail section, and a link connecting said second arm of the second lever to the rail section located rearwardly of said one rail section.

* * * * *